US009449482B2

(12) United States Patent
Piel et al.

(10) Patent No.: US 9,449,482 B2
(45) Date of Patent: Sep. 20, 2016

(54) METHOD AND APPARATUS FOR ACTIVATING AND DEACTIVATING VIDEO CAMERAS IN A SECURITY SYSTEM

(75) Inventors: Kevin G. Piel, Ronkonkoma, NY (US); Mike Garavuso, Lindenhurst, NY (US); Piotr Romanczyk, Melville, NY (US); Tom Babich, Glen Cove, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 189 days.

(21) Appl. No.: 12/836,147

(22) Filed: Jul. 14, 2010

(65) Prior Publication Data

US 2012/0013744 A1 Jan. 19, 2012

(51) Int. Cl.
*G08B 13/196* (2006.01)
*G08B 25/00* (2006.01)

(52) U.S. Cl.
CPC ..... *G08B 13/19676* (2013.01); *G08B 25/008* (2013.01)

(58) Field of Classification Search
USPC ..... 348/153
See application file for complete search history.

(56) References Cited

U.S. PATENT DOCUMENTS

| | | | | |
|---|---|---|---|---|
| 5,812,054 | A * | 9/1998 | Cohen | 340/506 |
| 6,163,257 | A * | 12/2000 | Tracy | 340/506 |
| 6,624,611 | B2 * | 9/2003 | Kirmuss | 320/104 |
| 7,239,236 | B1 | 7/2007 | Britton | |
| 2004/0041910 | A1 * | 3/2004 | Naidoo et al. | 348/156 |
| 2005/0001717 | A1 | 1/2005 | Bohbot et al. | |
| 2005/0253706 | A1 | 11/2005 | Spoltore et al. | |
| 2005/0264415 | A1 | 12/2005 | Katz | |
| 2006/0085831 | A1 | 4/2006 | Jones, III et al. | |
| 2007/0085671 | A1 | 4/2007 | Martin et al. | |
| 2007/0112939 | A1 * | 5/2007 | Wilson et al. | 709/219 |
| 2008/0048861 | A1 | 2/2008 | Naidoo et al. | |
| 2008/0169922 | A1 | 7/2008 | Issokson | |
| 2008/0278580 | A1 * | 11/2008 | Bentkovski | 348/143 |
| 2009/0167862 | A1 | 7/2009 | Jentoft et al. | |
| 2009/0200374 | A1 | 8/2009 | Jentoft | |

FOREIGN PATENT DOCUMENTS

| | | | |
|---|---|---|---|
| CN | 101002483 | A | 7/2007 |
| CN | 201285590 | Y | 8/2009 |
| CN | 101610396 | A | 12/2009 |
| CN | 201365259 | Y | 12/2009 |

(Continued)

OTHER PUBLICATIONS

European Search Report corresponding to Application No. EP 11 17 2292, dated Nov. 2, 2011.

(Continued)

*Primary Examiner* — Angela Nguyen
(74) *Attorney, Agent, or Firm* — Husch Blackwell LLP

(57) ABSTRACT

A method for using a security system to monitor a secured area is provided. The method includes a first processor of the security system providing a status of the security system, including an active status output signal and a disarmed status output signal, a video system monitoring the secured area by capturing and locally saving images, and a second processor of the video system activating one or more video cameras of the video system monitoring an interior space of the secured area upon receipt of the active status output signal and deactivating the one or more video cameras upon receipt of the disarmed status output signal.

20 Claims, 1 Drawing Sheet

(56) References Cited

FOREIGN PATENT DOCUMENTS

| | | |
|---|---|---|
| FR | 2 930 667 | 10/2009 |
| WO | WO 2008/056320 A1 | 5/2008 |

OTHER PUBLICATIONS

English translation of French Publication No. FR 2 930 667.
English-language abstract of Chinese patent publication CN 101002483A, dated Jul. 18, 2007.
English-language abstract of Chinese patent publication CN 201285590Y, dated Aug. 5, 2009.
English-language abstract of Chinese patent publication CN 201365259Y, dated Dec. 16, 2009.
English-language abstract of Chinese patent publication CN 101610396A, dated Dec. 23, 2009.
Search Report from corresponding Chinese patent application 201110195479.5, dated Dec. 23, 2015.
First Office Action from corresponding Chinese patent application 201110195479.5, dated Aug. 13, 2014.
English-language translation of First Office Action from corresponding Chinese patent application 201110195479.5, dated Aug. 13, 2014.
Second Office Action from corresponding Chinese patent application 201110195479.5, dated Dec. 30, 2015.
English-language translation of Second Office Action from corresponding Chinese patent application 201110195479.5, dated Dec. 30, 2015.

* cited by examiner

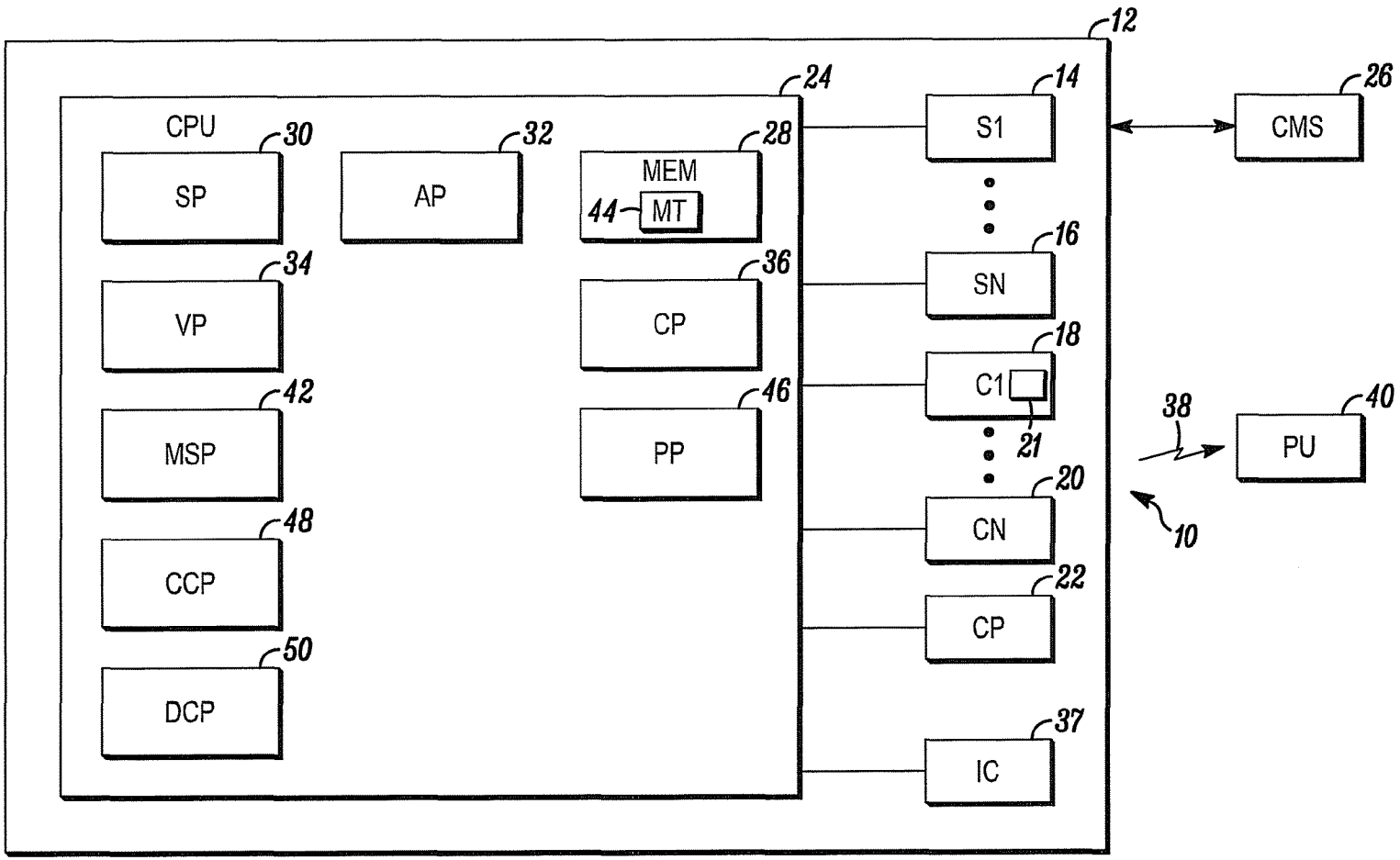
26
CMS
40
PU
38
10
12
14
S1
16
SN
18
C1
21
20
CN
22
CP
37
IC
24
28
MEM
MT
44
36
CP
46
PP
32
AP
CPU
30
SP
34
VP
42
MSP
48
CCP
50
DCP

METHOD AND APPARATUS FOR ACTIVATING AND DEACTIVATING VIDEO CAMERAS IN A SECURITY SYSTEM

FIELD OF THE INVENTION

The field of the invention relates to security systems, and more particularly, to the use of security cameras within security systems.

BACKGROUND OF THE INVENTION

The use of security cameras within security systems is generally known. Security cameras within such systems are typically located adjacent to and used to monitor points of entry of a secured area. Typically the security cameras are connected to a monitor used by a security guard located at a central monitoring station.

In automated systems, the output of a video camera may be processed by a video processor that processes a sequence of images to detect movement in the sequence. By detecting motion in the sequence of images, the video processor may be able to detect intruders without human involvement.

In addition to detecting movement, the output of video cameras is typically recorded in a memory device (e.g., a hard disk or removable flash media). The recording of such images is an important aspect of automated detection systems because the images can be used to later identify an intruder in the event that police arrive too late to arrest the intruder.

However, the automation of intrusion detection is often subject to false alarms. For example, the moving object detected by the video processor may be an animal or a curtain moved by the wind.

Security cameras have typically not gained much use in home monitoring systems. Part of the reason for this is that the connection between most homes and central monitoring stations is not fast enough to efficiently transfer video images. Another reason arises from concerns over privacy. Because of the importance of security systems, a need exists for better ways of using video monitoring in a home setting.

BRIEF DESCRIPTION OF THE DRAWINGS

FIG. 1 is a block diagram of a security system in accordance with an illustrated embodiment of the invention.

DETAILED DESCRIPTION OF AN ILLUSTRATED EMBODIMENT

FIG. 1 is a block diagram of a security and alarm system 10 shown generally in accordance with an illustrated embodiment of the invention. The security system 10 may be disposed within and used to protect a secured area 12 within a home of a user.

In general, the security system 10 may operate to protect the secured area 12 through the use of position sensors 14, 16 and imaging devices 18, 20. The position sensors 14, 16 may detect intruders at a particular position or point of entry, including a door or a window. The position sensors 14, 16 may also include PIR sensors that detect intruders via an infrared heat signature.

The imaging devices 18, 20 may include one or more video cameras. The cameras 18, 20 may be connected to a storage device 28 and to one or more image processors that detect intruders by processing image data to detect human presence in or around the secured area 12. Alternatively, the cameras 18, 20 may be provided to simply capture images in response to detection of a breach of security by one of the position sensors 14, 16 or as a means of monitoring and tracking activity within the secured area.

The position sensors 14, 16 and imaging devices 18, 20 may be independently monitored by a central processing unit (CPU) 24 containing a number of information processors. The position sensors 14, 16, cameras 18, 20 and a control panel 22 may be connected to the CPU 24 via a wireless or wired connection.

The control panel 22 may be used to control the security system 10 and to activate the intrusion and monitoring devices 14, 16, 18, 20 based upon an active status state of the security system. For example, all of the intrusion detectors 14, 16, 18, 20 may be active in an "ARM AWAY" mode and only the position sensors may be active in an "ARM STAY" mode.

Alarm modes may include ARM AWAY, ARM STAY, ARM STAY-INSTANT, TROUBLE and TEST. Some of the alarm modes may include sub-modes associated with entry/exit where intrusion is detected but where generation of an alarm is delayed pending entry of an authorization code.

The security system 10 can communicate either wirelessly or via a wired connection to a central monitoring station 26. Alternatively, or in addition, the connection may be via a local high speed Interconnect connection or telephone connection provided by the homeowner. The connection may be direct or be routed via a pass through service 52 (such as AlarmNet services).

In the event of detection of an intruder, an alarm signal may be sent to the central monitoring station 26. The alarm signal sent to the central monitoring station 26 may include an identifier of the home, an identifier of the breached access point or zone and one or more video images.

In general, the cameras 18, 20 are not used to record images from the interior spaces of the secured area 12 except under very specific conditions controlled by the homeowner user. As used herein, an interior space is an area that is not associated with entry detection. An interior space could be a hallway or bedroom. The specific conditions where images from interior spaces may be recorded include, for example, when the user is away from home and where the user has entered a predetermined code (e.g., a personal identification number (PIN)) through a control panel 22 followed an ARM AWAY mode selection button.

The control panel 22 will monitor for status change requests entered by a user through entry of the code. The control panel 22 may compare the entered code with a list of authorized codes. If the code matches a PIN of an authorized person, then the control panel 22 may cause the system 10 to enter the selected mode.

In the ARM AWAY mode, the control panel 22 may activate the position sensors 14, 16 directly and cameras 18, 20 via a video processor 34. The control panel 22 may monitor for intrusion alerts from one of the devices 14, 16, 18, 20.

Once activated, the cameras 18, 20 may capture images and transfer the captured images to a video processor 28 (either within the camera 18, 20 or within the CPU 24) where a content of successive images may be compared to detect the movement of intruders. Alternatively, captured images may simply be stored for some predetermined time period within memory 28.

In the event that one or more of the devices 14, 16, 18, 20 detect an intruder, the device 14, 16, 18, 20 may send an alert to a processor within the control panel 22. The control panel 22 may compose an alarm message and send the alarm message to the central monitoring station 26. The alarm message may include an identifier of the home and an identifier of the device 14, 16, 18, 20 from which the alarm originated. The alarm message may also include one or more video images from the cameras 18, 20.

In another instance, the homeowner user may enter a PIN number followed by the ARM STAY or ARM STAY-INSTANT button to enter an active status privacy mode. In this case, the control panel 22 may activate the position sensors 14, 16 and any perimeter cameras 18, 20, but not interior cameras 18, 20. In this case, a perimeter camera 18, 20 may be a camera that is directed towards access points (e.g., entry doors) of the secured area and captures images of persons passing through the access points.

In the ARM STAY mode, the control panel 22 may monitor the position sensors 14, 16 and any perimeter cameras 18, 20 for alarms. Upon detecting an alarm, the control panel 22 may report alarms to the central monitoring station 26 as described above.

In the ARM STAY mode, images from perimeter cameras 18, 20 may be processed to detect intruders. Interior cameras 18, 20 are deactivated or images are simply not processed or stored.

In order to confirm to the homeowner that his/her privacy is being maintained, each of the cameras 18, 20 may contain an indicator (e.g., a light, LCD display, etc.) 21 that indicates an active state. In this way, the homeowner may, at any time, visually confirm that only cameras 18, 20 on a perimeter of the secured area 12 are active rather than interior cameras 18, 20.

Under one illustrated embodiment, video from perimeter cameras 18, 20 is buffered for some time period (e.g., 10 seconds) in the video processor. If a device 14, 16 associated with a camera 18, 20 or the camera 18, 20, itself, triggers an alarm through motion detection, then video over some predetermined time period (e.g., 30 seconds including 10 seconds before and 20 seconds after the event) is saved to memory 28.

For example, a perimeter video camera 18, 20 may be directed towards an entry door with a position sensor 14, 16 that is activated by the door. If the homeowner opens the door, then the position sensor 14, 16 may generate an alert to the control panel 22. In response, the control panel 22 may cause the camera directed to the door to save video for the predetermined time period.

The control panel 22 may recognize the alert as originating from the entry door and enter an ENTRY/EXIT mode or submode. In this case, the control panel 22 may be programmed to recognize that, upon activation of the position sensor 14, 16 associated with the entry door, a 30 second delay may be provided in the ARM STAY or ARM AWAY modes (before transmission of an alarm message to the central station 26) to allow entry of a DISARM code through the control panel 22. In the ARM STAY-INSTANT mode, the alarm message may be immediately transmitted to the central station 26.

If the DISARM code is not entered within the 30 second delay, then the control panel 22 transmits an alarm message to the central monitoring station 26. The control panel 22 may also send a sequence of video images captured during the predetermined time period from the camera 18, 20 trained on the entry door to the central monitoring station.

The transmission of the sequence of images over the predetermined time period allows personnel at the central monitoring station 26 to evaluate the situation within the home 12 following activation of the position sensors 14, 16. For example, the homeowner could enter the wrong PIN number upon entering and an alarm would subsequently be sent to the central monitoring station 26. Similarly, the homeowner may forget about the alarm in the ARM STAY mode and simply leave the home without deactivating the alarm. However, in each case, personnel at the central monitor station 26 would have one or more images or a sequence of images from which to evaluate the situation. In the case of a homeowner leaving the home without turning off the alarm, the personnel can simply make a record of the event without the need to dispatch security personnel.

Similarly, in the case of the homeowner entering the wrong code, the personnel would have an image of the homeowner and could (by referring to reference images) recognize the homeowner. In this case, the personnel could simply place a telephone call to the homeowner requesting that the proper ID code be entered through the control panel 22 to verify his/her authorization to enter the home 12. Alternatively, if the images are of an intruder, the personnel are able to view an image of the intruder and forward a description of the intruder to police summoned in response to the intrusion.

Duress codes (otherwise known as ambush codes) could be handled in the same way by a processor within the control panel 22. As is known, a duress code is a series of digits and/or keystrokes used to indicate an emergency and to cause the security system 10 to enter an active status duress mode or alarm. In this case, a perimeter camera 18, 20 may be directed towards the control panel 22. In this case, video of the homeowner collected concurrent with entry of the duress code may give the personnel at the central monitoring station information to judge if an actual emergency exists and dispatch (or not dispatch) help accordingly.

In another embodiment, the homeowner may subscribe to receive notification messages from the security system 10. For example, a communication processor 36 within the CPU 24 may detect a predetermined event and send a message 38 to a portable unit (e.g., a cellular telephone, Internet phone, etc.) 40 of the homeowner. In this case, the message 38 may include text identifying the event as well as a sequence of images from a perimeter camera 18, 20.

For example, the homeowner may assign a number of different PIN numbers to different people authorized to access the home 12. A PIN number may be assigned to each of the children of the homeowner. Another PIN number may be assigned to a maid or cleaning service that accesses the home 12. Each PIN number may be used to define a different mode of the security system 10.

The PIN numbers and at least one available mode for each PIN number may be saved in a mode selection file 44. Upon entry of a PIN number and mode selection (or only the PIN number if only one mode is available for the PIN), the control panel 22 may determine a status mode for all or a portion of the security system 10 and also a set of steps for execution by the control panel 22.

The mode assumed by the mode selection of the control panel 22 may be based upon the PIN and mode selection (by themselves) or a newly assumed mode may be based upon the entered PIN, the mode selection and the previous mode.

For example, in case of an ARM AWAY mode and entry of a PIN number assigned to a child of the homeowner, the status processor 30 may be programmed to send a message 38 and sequence of video images to the homeowner each time the PIN number is entered through the control panel 22. This may be used so that the homeowner has a visual image each time one or more of his children returns home and enters his or her PIN number through the control panel 22.

The entry of the PIN number of the child may cause the security system 10 to assume an ARM STAY mode from the ARM AWAY mode.

In the case of a cleaning service, the entry of a PIN number assigned to the maid or cleaning service and activation of a DISARM mode selection button may cause the security system 10 to assume a unique active status mode where the position sensors 14, 16 are deactivated, but where the activities of the maid or cleaning service are monitored through the cameras 18, 20 and saved to memory 28. In this case, entry of the PIN number and mode selection button may also cause a message 38 to be sent to the homeowner along with activation of some or all of the perimeter and interior cameras 18, 20. The message 38 gives indication to the homeowner of when the maid or cleaning service arrived, as well as an image of the person entering the PIN. By activating one or more of the interior cameras and sending images in messages 38 to the homeowner on a continuous or intermittent basis, the homeowner has the ability to observe the activity of the maid or cleaning service. The maid cannot disable the cameras 18, 20 using his/her PIN number.

Other modes may include a trouble mode that may be detected by loss of a signal from a position sensor 14, 16 or camera 18, 20 or by receipt of some other fault signal from a position sensor 14, 16 or camera 18, 20. In this case, the control panel 22 may detect the trouble signal and enter an active status trouble mode for that portion of the area 12 and cause one or more of the surrounding cameras 18, 20 to monitor and record images of the source of the trouble signal. The control panel 22 may send a trouble notification, including images, to the central station 26 for evaluation.

Another mode may include an activate status mode for testing. In this case, all of the cameras 18, 20 may be activated while a technician sequentially walks through the area 12 while the security system 10 collects video and transmits images to the central station 26 for verification of proper operation.

A specific embodiment of a security system has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

an alarm system of a home having a plurality of modes;

a control panel of the alarm system located within a secured area of the home;

a plurality of video cameras monitoring the secured area of the home, the plurality of video cameras including at least one of the plurality of video cameras monitoring a periphery of the secured area and at least one other of the plurality of video cameras monitoring an interior space;

a first processor of the alarm system determining a mode of the plurality of modes of the alarm system from a personal identification number entered by a user or the entered personal identification number and a mode selection button selected by the user through the control panel of the alarm system, wherein the mode determined by the first processor is based upon the entered personal identification number and the selected mode selection button, by themselves, or is based upon the entered personal identification number, the selected mode selection button and a previous mode;

a video system monitoring the secured area by capturing and saving images to a memory of the secured area; and a second processor of the video system that selectively activates at least one camera of the plurality of video cameras of the video system monitoring the secured area in each of the plurality of modes based upon the mode determined by the first processor, wherein at least one of the plurality of modes includes activating the at least one of the plurality of video cameras monitoring the periphery of the secured area and the at least one other of the plurality of video cameras monitoring the interior space, wherein, upon entry of the personal identification number, the at least one of the plurality of video cameras captures an image of the user entering the personal identification number through the control panel within the secured area and sends a message to a homeowner, including the image of the user, each time the personal identification number is entered through the control panel, and wherein, by activating the at least one of the plurality of video cameras monitoring the periphery of the secured area and the at least one other of the plurality of video cameras monitoring the interior space in the at least one of the plurality of modes, the homeowner, on a continuous or intermittent basis, observes activity of the user.

2. The method as in claim 1 further comprising activating an indicator disposed on one or more of the plurality of cameras to indicate that the one or more of the plurality of cameras is activated.

3. The method as in claim 1 further comprising a status change processor monitoring the control panel for a status change request entered by the user.

4. The method as in claim 1 further comprising a duress code processor monitoring the control panel for a duress code entered by the user.

5. The method as in claim 3 further comprising a camera control processor activating a camera of the plurality of video cameras proximate the control panel for a predetermined time period following entry of the status change request by the user.

6. The method as in claim 4 further comprising a camera control processor activating a camera of the plurality of video cameras proximate the control panel for a predetermined time period following entry of the duress code by the user.

7. A security system comprising:

a control panel of the security system located within a secured area of a home;

a plurality of intrusion sensors that monitor the secured area of a home;

a plurality of cameras that record and save images within the secured area, at least one of the plurality of cameras monitoring a perimeter of the secured area and at least one other of the plurality of cameras monitoring an interior of the secured area;

a first processor that determines a mode of a plurality of modes of the security system from a personal identification number entered by a user or the entered personal identification number and a mode selection button selected by the user through the control panel of the security system, wherein the mode determined by the first processor is based upon the entered personal identification number and the selected mode selection button, by themselves, or is based upon the entered personal identification number, the selected mode selection button, and a previous status, wherein the first processor activates at least some of the plurality of cameras in each of the plurality of modes based upon the determined mode, and wherein at least one of the plurality of modes includes activating the at least one of the plurality of cameras monitoring the perimeter of the secured area and the at least one other of the plurality of cameras monitoring the interior of the secured area; and a second processor that forwards the images from the plurality of cameras to a predetermined destination based upon the determined mode, wherein, upon entry of the personal identification number, a camera of the plurality of cameras captures an image of the user entering the personal identification number through the control panel within the secured area and sends a message to a homeowner, including the image of the user, each time the personal identification number is entered through the control panel, and wherein, by activating the at least one of the plurality of cameras monitoring the perimeter of the secured area and the at least one other of the plurality of video cameras monitoring the interior of the secured area in the at least one of the plurality of modes, the homeowner, on a continuous or intermittent basis, observes activity of the user.

8. The security system as in claim 7 wherein the secured area further comprises a home.

9. The security system as in claim 7 further comprising a video processor that collects a sequence of images based upon an alarm alert from one of the plurality of intrusion sensors or from the plurality of cameras.

10. The security system as in claim 7 wherein the control panel receives status change requests.

11. The security system as in claim 9 further comprising a communication processor that sends the sequence of images to a central monitoring station.

12. The security system as in claim 11 wherein the sequence of images further comprises images collected proximate an entry point to the secured area during a predetermined time period before and after detection of the alarm alert.

13. The security system as in claim 10 wherein the status change requests further comprise the personal identification number.

14. The security system as in claim 13 further comprising a mode selection processor that selects a new mode based upon a previous mode and the entered personal identification number.

15. The security system as in claim 14 further comprising a video processor that collects a sequence of images based upon the new mode.

16. The security system as in claim 15 further comprising a communication processor that sends the sequence of images to the homeowner.

17. The security system as in claim 16 wherein the sequence of images further comprises images collected proximate the control panel during a predetermined time period before and after entry of the personal identification number.

18. An apparatus comprising:

a security system having a plurality of modes that monitors a secured area of a home;

a control panel of the security system located within the secured area;

a first processor of the security system that determines a mode of the plurality of modes of the security system from a personal identification number entered through the control panel of the security system or the entered personal identification number and a mode selection button selected by a user through the control panel of the security system, wherein the mode determined by the first processor is based upon the entered personal identification number and the selected mode selection button, by themselves, or is based upon the entered personal identification number, the selected mode selected button, and a previous mode;

a video system that monitors the secured area by capturing and locally saving images; and a second processor of the video system that activates one or more video cameras of the video system monitoring the secured area in each of the plurality of modes based upon the determined mode of the security system, wherein at least one of the plurality of modes includes activating at least one video camera monitoring a periphery of the secured area and at least one video camera monitoring an interior space, wherein, upon entry of the personal identification number, the at least one video camera monitoring the periphery of the secured area captures an image of the user entering the personal identification number through the control panel within the secured area and sends a message to a homeowner, including the image of the user, each time the personal identification number is entered through the control panel, and wherein, by activating the at least one video camera monitoring the periphery of the secured area and the at least one video camera monitoring the interior space in the at least one of the plurality of modes, the homeowner, on a continuous or intermittent basis, observes activity of the user.

19. The apparatus as in claim 18 wherein the first processor further comprising a mode file containing a plurality of personal identification numbers and respective ones of the plurality of modes associated with each of the plurality of personal identification numbers.

20. The apparatus as in claim 18 further comprising a communication processor that forwards a sequence of images from the one or more video cameras to the homeowner based upon the determine mode.

* * * * *